US005301763A

United States Patent [19]

Peay et al.

[11] Patent Number: 5,301,763

[45] Date of Patent: Apr. 12, 1994

[54] APPARATUS FOR DRILLING HOLES IN MINE ROOFS AND A ROOF DRILL BIT FOR USE THEREIN

[75] Inventors: Kent Peay, Bristol, Tenn.; Lawrence E. Gray, Bristol, Va.

[73] Assignee: Sandvik Rock Tools, Inc., Bristol, Va.

[21] Appl. No.: 25,249

[22] Filed: Mar. 2, 1993

[51] Int. Cl.[5] ..... E21B 10/54

[52] U.S. Cl. ..... 175/398; 175/426

[58] Field of Search ..... 175/427, 428, 432, 415, 175/398, 426, 431

[56] References Cited

U.S. PATENT DOCUMENTS 2,174,791 10/1939 Kruttschmitt ..... 175/415 X 5,180,022 1/1993 Brady ..... 175/432 X

*Primary Examiner*—Willilam P. Neuder

*Attorney, Agent, or Firm*—Burns, Doane, Swecker & Mathis

[57] ABSTRACT

A roof drill bit for drilling a bolt hole in a mine roof comprises a body defining a longitudinal axis of rotation and having an external periphery and a front face. A longitudinal fluid channel is formed in the external periphery for conducting a flow of flushing fluid to the front face. An imaginary longitudinal plane which contains the axis of rotation serves to bisect the front face into first and second sides. A cutting edge arrangement is defined by at least one cutting insert mounted on the body. The insert is positioned to be acted upon by the flow of flushing fluid. At least one support pad is mounted on the external periphery for balancing cutting forces acting on the drill bit. The cutting arrangement is asymmetrical with respect to the axis of rotation such that the cutting edge arrangement is disposed on one of the sides, and the other side is substantially free of the cutting edge arrangement.

14 Claims, 2 Drawing Sheets

FIG. 4
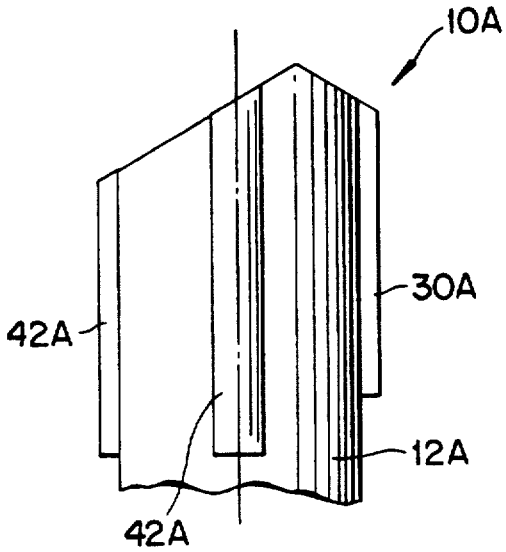
FIG. 5
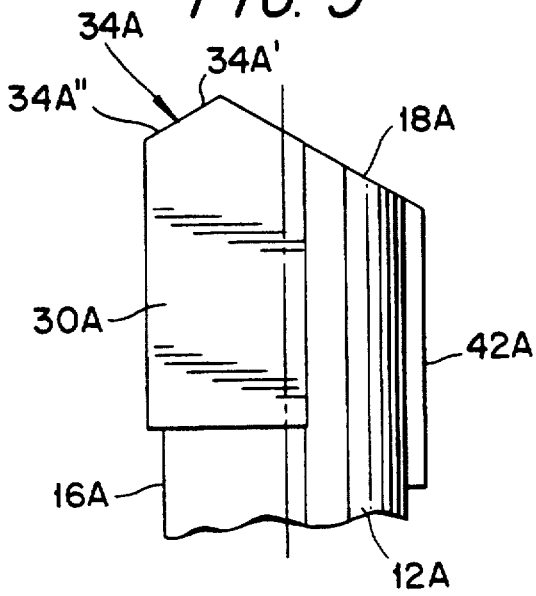
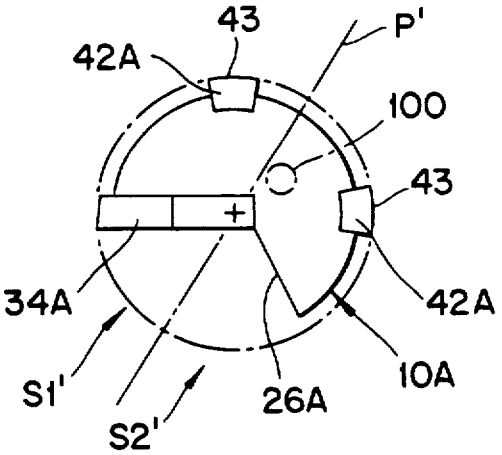
FIG. 6
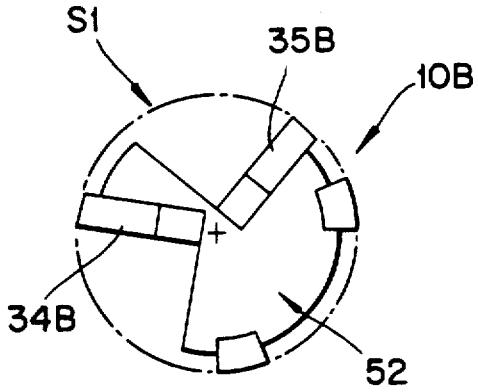
FIG. 7

APPARATUS FOR DRILLING HOLES IN MINE ROOFS AND A ROOF DRILL BIT FOR USE THEREIN

BACKGROUND OF THE INVENTION

The present invention relates to the support of mine roofs and, in particular, to an apparatus including a roof drill bit for drilling bolt holes in mine roofs.

During a mining operation, the roof of the mine must be supported. This has traditionally been accomplished by bolting support plates to the roof after bolt-receiving holes have been drilled into the roof.

It has been conventional to drill the bolt-receiving holes by means of a drill bit comprised of a body having a plurality of cutting edges spaced apart circumferentially on a front face of the body. The cutting edges can be formed by cutting inserts made of a hard material such as cemented carbide or polycrystalline diamond for example.

The drill bit includes a rearwardly extending shank of non-circular cross-section mounted in the hollow front end of a drill bar which forms a drive shaft for the insert.

Each cutting edge communicates with a respective longitudinal channel formed along an external periphery of the body. Flushing water is directed upwardly under pressure through the drill bar and then along the channels for flushing away the cuttings and cooling the cutting edge. The water-entrained cuttings exit the hole through an annulus formed between the drill and the side wall of the hole. By flushing away the cuttings, the cutting edges stay sharper longer and the rate of drilling is increased, because the cutting edges do not have to re-cut the cuttings. Also, the cooling of the cutting edges extends their life, especially in the case of cutting edges formed of polycrystalline diamond.

Although prior art drills have functioned to flush cuttings and cool the inserts, room for improvement remains. In that regard, if the flow pattern of the cooling fluid could be improved to provide an enhanced removal of cuttings and insert cooling, it is possible that the rate of drilling could be increased, the insert life and cutting edge sharpness could be extended, and/or fewer inserts (i.e., a less expensive drill) could be used to achieve drilling rates which are comparable to presently available rates. The present invention has as its goal the attainment of some or all of those advantages.

SUMMARY OF THE INVENTION

The present invention relates to a drilling apparatus for drilling a bolt hole in a mine roof, the apparatus comprising a drill bar and a drill bit mounted at a front end of the drill bar.

The present invention also relates to the roof drill bit per se. The roof drill bit comprises a body defining a longitudinal axis of rotation and having an external periphery and a front face. A longitudinal fluid channel is formed in the external periphery for conducting a flow of flushing fluid. A cutting edge arrangement is carried by the body and is defined by at least one cutting insert mounted on the body. The cutting edge arrangement projects forwardly beyond the front face, and laterally beyond the external periphery. At least a portion of the cutting edge arrangement is inclined rearwardly and laterally outwardly. The insert is positioned to be acted upon by the flow of flushing fluid. An imaginary longitudinal plane which contains the axis of rotation serves to bisect the body into first and second sides. At least one support pad is mounted on the external periphery in circumferentially spaced relationship to the cutting insert in order to balance the cutting forces acting on the drill bit during a drilling operation. The cutting edge arrangement is asymmetrical relative to the axis of rotation such that the cutting edge arrangement is disposed on one of the sides, and the other side is substantially free of the cutting edge arrangement.

Preferably, a portion of the outer periphery spaced circumferentially from the insert is truncated to define an enlarged passage through which the fluid may flow.

There can be only a single insert, or more than one insert such as two inserts could be provided, as long as the overall cutting edge arrangement defined by the plurality of inserts is asymmetrical with respect to the axis of rotation.

BRIEF DESCRIPTION OF THE DRAWINGS

The objects and advantages of the invention will become apparent from the following detailed description of preferred embodiments thereof in connection with the accompanying drawings in which like numerals designate like elements, and in which:

FIG. 4 is a side elevational view of a second embodiment of a roof drill bit according to the present invention;

FIG. 5 is a side elevational view of the roof drill bit taken at a location displaced 180° from the location of FIG. 4;

FIG. 6 is an end view of the roof drill bit depicted in FIG. 4; and

FIG. 7 is an end view of a third embodiment of a roof drill bit according to the present invention.

DETAILED DESCRIPTION OF PREFERRED EMBODIMENTS OF THE INVENTION

Figure 1:
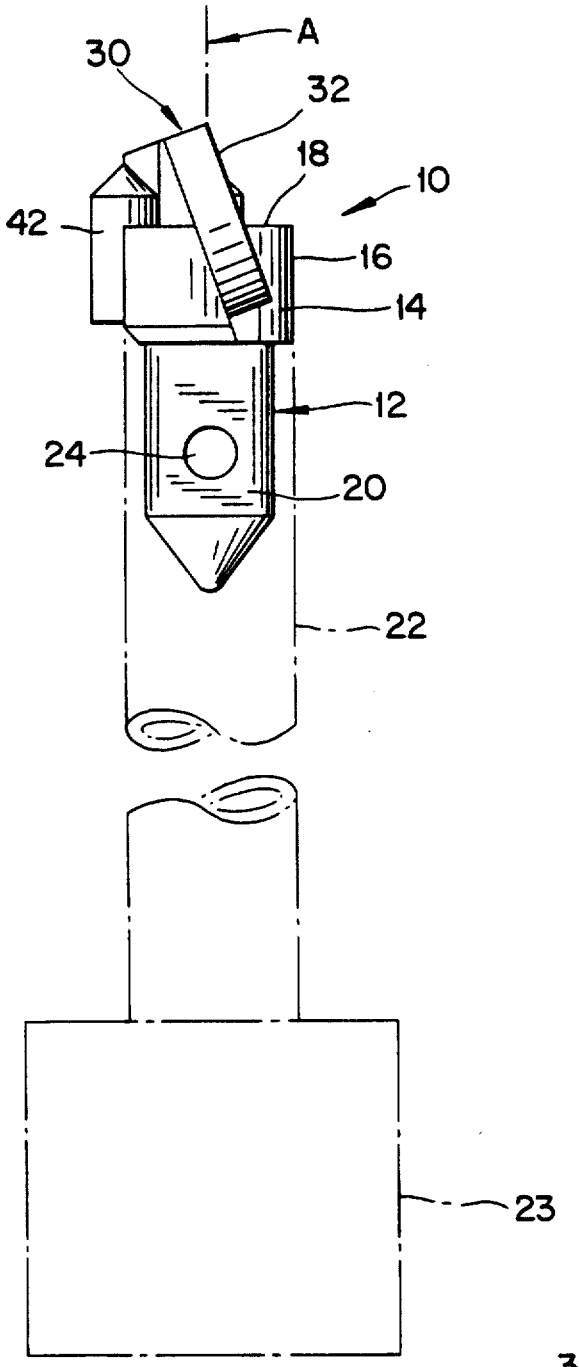
FIG. 1 is a side elevational view of a first embodiment of a roof drill bit according to the present invention, with a drill bar and drive for the drill bar shown in phantom lines.
Figure 2:
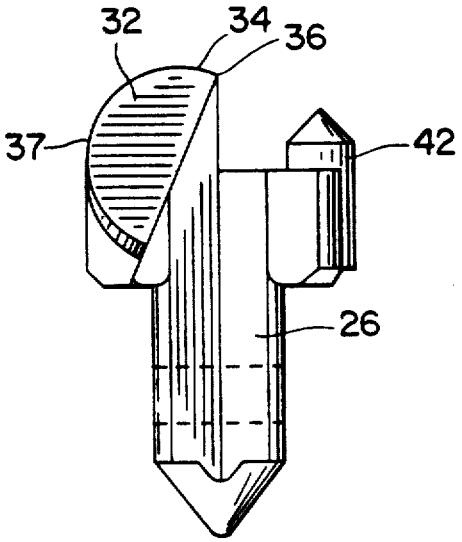
FIG. 2 is a side elevational view of the roof drill bit at a location displaced 90° from the view of FIG. 1.
Figure 3:
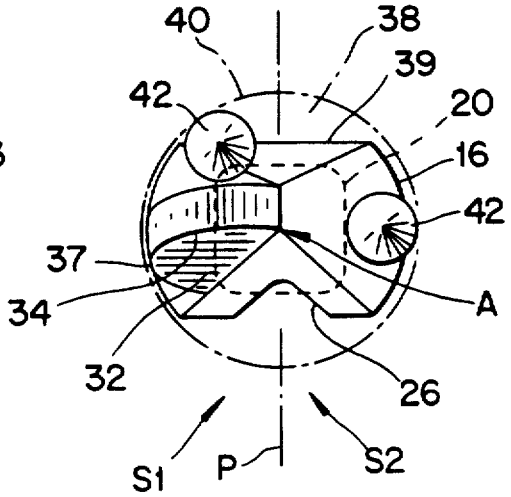
FIG. 3 is an end view of the roof drill bit depicted in FIG. 1.

A mine roof drill bit 10 disclosed in connection with FIGS. 1-3 comprises a body 12 which defines a longitudinal axis of rotation A. The body 12 includes a front portion 14 having a front face 18, and a rearwardly projecting shank 20 which is of smaller cross-section than the front portion 14. The external periphery 16 of the front portion 14 is generally cylindrical, whereas the shank 20 has a generally polygonal external periphery, as can be seen in FIG. 3. The body is formed of high strength steel and can be machined from a forging, or completely machined from bar stock, or machined from a casting.

The shank 20 is dimensioned for insertion into a hollow drill bar 22 and connected thereto, e.g., by a pin inserted into a hole 24 of the shank 20 which is aligned with a hole (not shown) in the drill bar. The drill bar 22 is connected to a conventional drive mechanism 23 which rotates the drill bar and directs a supply of flushing fluid, preferably a liquid (e.g., water) upwardly through the drill bar.

Formed in the external peripheries of the front portion 14 and the shank 20 is a longitudinal channel 26 which extends to the front face 18. It will be appreciated that flushing water flowing through the drill bar 22 will continue upwardly within the channel 26 to the front face 18.

Mounted in the front face 18 is a cutting insert 30 in the form of a semi-cylindrical disk having an outer surface 32 formed of a highly wear-resistant hard material, such as cemented carbide or polycrystalline diamond, for example. That insert forms a curved cutting edge 34 which is inclined rearwardly and laterally outwardly from its forwardmost point 36 (see FIG. 2). The laterally outermost portion 37 of the cutting edge is situated laterally beyond the external periphery of the body 12 (see FIG. 3). The insert 30 is brazed to the body 12 at a suitable angle of attack such as a positive, negative, or zero attack angle. (In lieu of brazing, the insert could be attached by a mechanical fastener.) The insert is arranged such that its front surface 32 lies in communication with the channel 26, so that flushing water flowing within the channel will flow across the surface 32 and the cutting edge 34 to flush cuttings therefrom.

The cutting edge arrangement is asymmetrical relative to the axis A. That is, there is no cutting edge located diametrically opposite the cutting edge 34. Rather, a longitudinal plane P can be inscribed (see FIG. 3) which contains the axis of rotation A and which divides the front face 18 into two halves S1, S2, wherein substantially all of the cutting edge 34 is located in one half S1 and the other half S2 is substantially free of cutting edges. The plane P could be oriented so as to bisect the fluid channel 26. The half S2 provides an unobstructed region into which the flushing water can flow after passing across the insert. That flushing water is then distributed to the outer circumference of the body 12 where it flows out of the hole being drilled, along an annulus 38 formed between the external periphery of the bit and the wall 40 of the hole. A portion of the external periphery of the bit is truncated at 39 to form a relatively wide longitudinal passage which facilitates the flow of flushing water.

It has been found that by making one-half of the front face 18 substantially free of cutting edges, the flushing of cuttings is considerably improved over the prior art arrangement of symmetrically arranged cutting edges. In the prior art symmetrical arrangement, the flushing water emerging from each fluid channel has a limited area in which it can travel to the annulus 38. As a result, it is difficult for the water to establish a flow path which efficiently removes cuttings from in front of the cutting edges, requiring that the cutting edges re-cut the cuttings. However, by making one half of the front face substantially free of cutting edges, the water has a much greater area to which to flow and be distributed to the annulus, and is better able to establish a flow path which efficiently removes the cuttings located in front of the cutting edge.

By removing the cuttings more efficiently, the drilling rate can be increased, and the cutting edge stays sharper longer. There is also improved cooling of the cutting edge which increases its life, especially in the case of an insert formed of polycrystalline diamond which is relatively temperature sensitive.

In addition, the present invention avoids another problem which is characteristic of prior art bits having symmetrically arranged cutting edges. That is, if there occurs an uneven wearing of those cutting edges, the cutting forces acting on the bit can become unbalanced, whereupon the bit wobbles and drills holes of oversized diameter, and/or drill holes which are curved (wavy) thereby making it difficult to remove the drill bit and drill bar from the hole. Also, the drill rod may suffer excessive wear from rubbing against the wavy hole.

Those problems will not develop in the case of the present bit wherein there is an asymmetrical cutting edge arrangement. In order to ensure that the forces acting on the bit 10 during cutting are properly balanced, support pads 42 are mounted on the external periphery of the body 12 at locations suitable for balancing out the forces. Those support pads, which are in the shape of cylinders formed of a hard material such as cemented carbide or polycrystalline diamond for example, project radially beyond the external periphery of the body 12. While two support pads 42 are depicted, there could instead be provided more or fewer support pads, as deemed necessary to balance the cutting forces. The support pads can be attached by any suitable means, such as by brazing for example.

Another preferred embodiment of the bit 10A is depicted in FIGS. 4–6. In that bit 10A, the cutting insert 30A is of polygonal shape (see FIG. 5) and has a pointed cutting edge 34A formed by forwardly converging inner and outer edge sections 34A', 34A''. The outer edge section 34A'' projects laterally beyond the external periphery 16A of the body 12A, and the inner edge section 34A' projects slightly over to the opposite side S2' of the plane P' (i.e., the cutting edge cuts on both sides of the axis of rotation). However, it will be appreciated that the cutting edge arrangement is asymmetrical, the bit being substantially free of cutting edges on that side S2'. That portion of the front face 18A located on that side S2' is inclined rearwardly from the center to the outer circumference to facilitate the flow of flushing water once the flushing water has passed across the insert 30A.

Support pads 42A are provided which are in the form of rectangular strips having slightly curved outer faces 43.

The bit 10A provides the same advantages noted earlier in connection with the bit 10 in that there can be achieved a more efficient removal of cuttings and an enhanced cooling of the insert 30'.

It is possible to provide a roof bit according to the present invention with more than one insert, as depicted in FIG. 7. In that embodiment, a roof bit 10B has two inserts 34B, 35B disposed within one half S1 of the front face. The inserts are spaced apart by about 120°, so that the cutting edge arrangement defined by the two inserts is asymmetrical with respect to the axis of rotation. That is, the half S2 of the front face is substantially free of cutting edge arrangement.

The path of the flushing water has been earlier described as being directed forwardly through the channel 26. Alternatively, that path could be reversed, i.e., the flushing water could be directed forwardly within a hole 100 drilled through the bit (e.g., see the hole 100 shown in FIG. 6), and then directed rearwardly through the channel 26 (or 26A). In such a case, the hole would communicate with the inside of the bar 22, but the channel 26 would not. Instead, water flowing rearwardly through the channel 26 would then travel between the bar 22 and the wall of the hole being drilled.

Although the present invention has been described in connection with preferred embodiments thereof, it will be appreciated by those skilled in the art that additions, modifications, substitutions, and deletions not specifically described may be made without departing from the spirit and scope of the invention as defined in the appended claims.

What is claimed is:

1. A roof drill bit for drilling a bolt hole in a mine roof while flushing fluid is circulated into and from the hole, comprising:

a body defining a longitudinal axis of rotation and having an external periphery and a front face, a longitudinal fluid channel formed in said external periphery for conducting the flushing fluid, an imaginary longitudinal plane which contains said axis of rotation serving to bisect said front face into first and second sides;

cutting edge means carried by said body and defined by at least one cutting insert mounted on said body, said cutting edge means projecting forwardly beyond said front face, and projecting laterally beyond said external periphery, at least a portion of said cutting edge means being inclined rearwardly and laterally outwardly, said at least one insert being positioned to be acted upon by the flushing fluid; and at least one support pad mounted on said external periphery in circumferentially spaced relationship to said cutting insert for balancing cutting forces acting on said drill bit during a drilling operation;

said cutting edge means being asymmetrical relative to said axis of rotation such that said cutting edge means is disposed on one of said sides, and the other side is substantially free of cutting edge means.

2. A roof drill bit according to claim 1, wherein said at least one insert comprises a single insert.

3. A roof drill bit according to claim 1, wherein said at least one insert comprises two inserts, there being a fluid channel for each insert.

4. A roof drill bit according to claim 1, wherein said cutting edge means comprises a curved cutting edge.

5. A roof drill bit according to claim 4, wherein said cutting edge means comprises forwardly converging generally straight cutting edge sections.

6. A roof drill bit according to claim 1, wherein said at least one insert is formed of a hard material.

7. A roof drill bit according to claim 1, wherein said at least one support pad is disposed on said other side.

8. A roof drill bit according to claim 1, wherein said at least one support pad is of generally cylindrical shape.

9. A roof drill bit according to claim 1, wherein a portion of said outer periphery spaced circumferentially from said at least one insert is truncated to define an enlarged passage through which the flushing fluid may flow.

10. A roof drill bit according to claim 1, wherein said at least one support pad is of generally rectangular shape.

11. In an apparatus for drilling a bolt hole in a mine roof while flushing fluid is circulated into and from the hole, comprising a drill bar; a drill bit mounted at a front end of said drill bar; and means for rotating said drill bar and drill bit, the improvement wherein said drill bit comprises:

a body defining a longitudinal axis of rotation and having an external periphery and a front face, a longitudinal fluid channel formed in said external periphery for conducting a flow of flushing fluid, an imaginary longitudinal plane which contains said axis of rotation serving to bisect said front face into first and second sides;

cutting edge means carried by said body and defined by at least one cutting insert mounted on said body, said cutting edge means projecting forwardly beyond said front face, and projecting laterally beyond said external periphery, at least a portion of said cutting edge means being inclined rearwardly and laterally outwardly, said at least one insert being positioned to be acted upon by the flow of flushing fluid; and at least one support pad mounted on said external periphery in circumferentially spaced relationship to said cutting insert for balancing cutting forces acting on said drill bit during a drilling operation;

said cutting edge means being asymmetrical relative to said axis of rotation such that said cutting edge means is disposed on one of said sides, and the other side is substantially free of cutting edge means.

12. Apparatus according to claim 11, wherein said flow of flushing fluid travels from said fluid channel to an annulus formed between said external periphery and the hole being drilled.

13. Apparatus according to claim 11, wherein said flushing fluid comprises water.

14. Apparatus according to claim 10, wherein a portion of said outer periphery spaced circumferentially from said at least one insert is truncated to define an enlarged passage through which the fluid may flow away from said front face.

* * * * *